US005700142A

United States Patent [19]

Miller et al.

[11] Patent Number: 5,700,142

[45] Date of Patent: Dec. 23, 1997

[54] LIQUID PILOT ASSEMBLY

[75] Inventors: Scott Miller, Butler; Don Brady; Steven Williamson, both of Wayne; Steven Luftig, Oakland; Dominick Musto, Middlesex, all of N.J.

[73] Assignee: Symtron Systems, Inc., Fair Lawn, N.J.

[21] Appl. No.: 660,096

[22] Filed: Jun. 6, 1996

[51] Int. Cl.[6] ..... F23Q 2/32

[52] U.S. Cl. ..... 431/125; 431/2; 431/202; 431/252; 431/260; 434/226

[58] Field of Search ..... 431/126, 2, 125, 431/7, 252, 260, 202; 126/360 A; 239/18; 434/226

[56] References Cited

U.S. PATENT DOCUMENTS

| | | | |
|---|---|---|---|
| 626,723 | 6/1899 | Roberts | 431/252 |
| 3,038,064 | 6/1962 | Gieb | 431/125 |
| 3,104,814 | 9/1963 | Boerder | 239/18 |
| 3,565,337 | 2/1971 | Ditto | 239/18 |
| 3,830,217 | 8/1974 | Maness et al. | 239/18 |
| 3,892,519 | 7/1975 | Reed et al. | 431/202 |
| 4,110,063 | 8/1978 | Mitchell | 431/125 |
| 4,858,826 | 8/1989 | Robinson et al. | 239/18 |
| 5,374,191 | 12/1994 | Herman et al. | 434/226 |
| 5,415,551 | 5/1995 | Semenza | 434/226 |

*Primary Examiner*—Carl D. Price

*Attorney, Agent, or Firm*—Richard T. Laughlin, Esq.; Graham, Curtin & Sheridan

[57] ABSTRACT

A liquid pilot assembly for use in an outdoor fuel spill fire fighting trainer is provided. This assembly includes a spark plug igniter unit, a liquid fuel system, an air distribution system, a housing enclosing the components and a vaporization subassembly disposed within the housing for changing liquid fuel to vapor fuel.

9 Claims, 2 Drawing Sheets

LIQUID PILOT ASSEMBLY

FIELD OF THE INVENTION

The invention generally relates to a liquid pilot assembly and, in particular, the invention relates to a liquid pilot assembly which has a vaporizing subassembly for use in an outdoor fuel spill fire fighting trainer.

BACKGROUND OF THE INVENTION

The prior art aircraft fire fighting trainer is described in U.S. Pat. No. 5,415,551 issued May 16, 1995.

The prior art fire fighting trainer includes a mock-up aircraft or other equipment simulation, a liquid fuel distribution and burner system having a liquid fuel supply line, a burner control connected to the liquid fuel supply line, and a central control connected to the burner control.

One problem with the prior art fire fighting trainer is that there is no easy method of igniting the liquid propane fuel.

SUMMARY OF THE INVENTION

According to the present invention, a pilot module assembly is provided which is a self-igniting, continuous flame device which is used to reliably ignite combustible fuel supplies. This assembly has an igniter unit to electronically light the pilot flame, a liquid fuel distribution system, an air distribution system, a housing and a vaporizer system which is disposed inside the housing.

By using the vaporizer system, which is disposed inside the housing, the present invention eliminates the need for a separate vaporizer system, which has valves and regulators, which is disposed near to a supply tank and which has a supply network line to the igniter unit(s). Further, it can be submerged in water, with only the upper surface of the assembly exposed to view.

One object of the invention is to provide a pilot module assembly for an aircraft fire fighting trainer for safe operation and control of the trainer.

Another object of the invention is to provide a pilot module assembly which has an integral vaporizer.

A further object of the invention is to provide a structure in a fire fighting trainer which simulates a liquid fuel spill fire outside a mock-up aircraft.

Other objects and the advantages of the invention will occur to one skilled in the art from the following detailed description of the preferred embodiment of the invention as illustrated in the accompanying drawings.

DESCRIPTION OF THE PREFERRED EMBODIMENT

Figure 1:
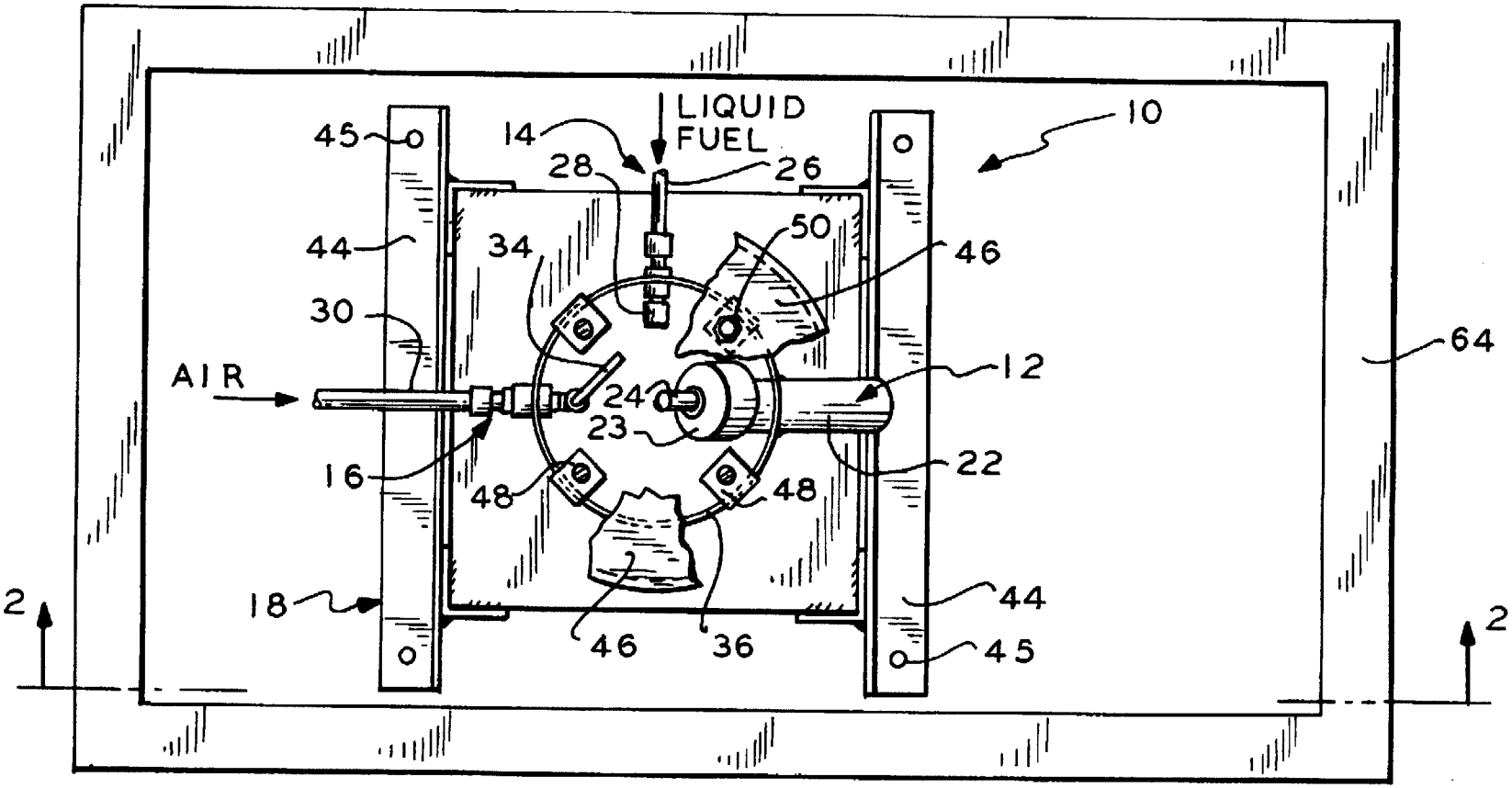
FIG. 1 is a plan view of a liquid pilot assembly according to the present invention.
Figure 2:
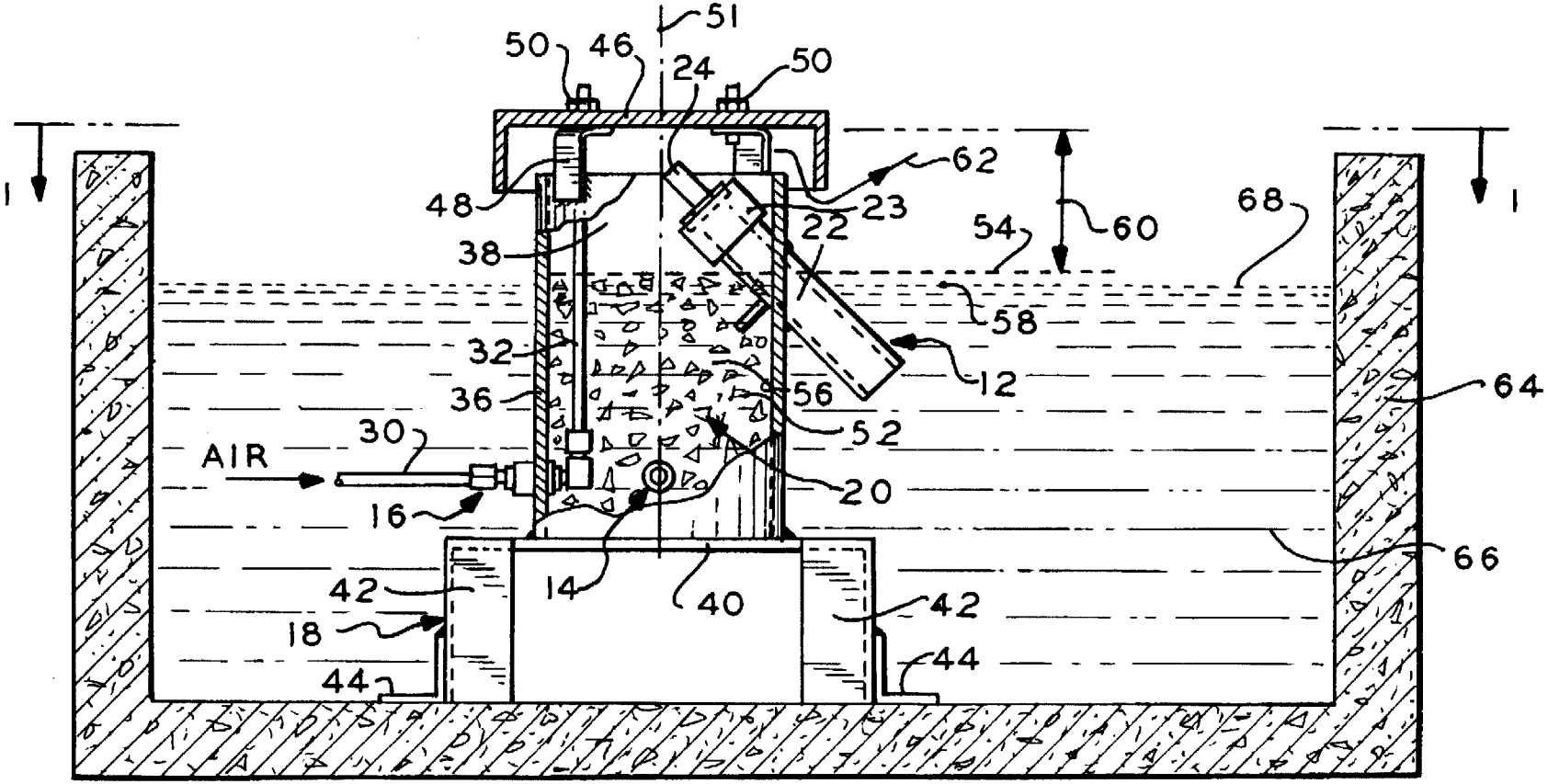
FIG. 2 is a section view as taken along the line 2—2 of FIG. 1.

Referring to FIGS. 1 and 2, a liquid pilot assembly generally indicated at 10 is provided. The assembly 10 includes a spark plug igniter unit generally indicted at 12, a liquid fuel supply system 14, an air distribution system 16, a housing generally indicated at 18 and a vaporization system or subassembly 20.

The spark plug igniter unit 12 has an inclined pipe 22, which is supported by the housing 18, a cap 23 which is supported by the inclined pipe 22 and a spark plug 24 which is supported by the cap 23. The spark plug is preferably of the turbine engine type which does not have a spark gap. The spark plug 24 has a control circuit or remote control unit (not shown) so it can be controlled from any point.

The fuel system 14 has an inlet line 26 and a lower outlet nozzle or nozzle portion 28 which is supported by the housing 18.

The air system 16 has an inlet line 30, which is supported by the housing 18 and has a vertical tube 32. The vertical tube 32 has an upper outlet nozzle 34, which is arranged to cause a circular air flow or air swirl in the system.

The housing 18 has a cylindrical or peripheral shell or wall or plate 36, which forms a chamber 38. The shell 36 has a floor plate 40 welded thereto. The plate 40 is supported by four framing or leg angles 42. The angles 42 are supported by two bearing angles 44 which have respective anchor bolt holes 45. The housing 18 also has a cover or hood 46, which is bolted to four angle pieces or clip angles 48, that are respectively welded to the shell 36. The clip angles 48 have respective bolts 50 for holding the hood 46. The shell 36 has an axis 51.

The vaporizer 20 has a plurality of gravel stones 52, which are disposed in the chamber 38 to a fixed gravel level 54. The vaporizer 20 also has a volume of water 56 which is disposed between stones 52 in the chamber 38 to a variable water level 58. Water 56 may have a separate water supply line (not shown) and level control such as a float valve (not shown), as desired.

Liquid propane enters the chamber 38 from the nozzle 28 and is vaporized by the thermal exchange of the gravel and the water 56 to cause propane vapor above the water level 58.

The cylinder 36, and the gravel 52 at its level 54, and the hood 46 enclose a propane vapor ignition zone or space 60. The propane vapor in the zone 60 is swirled about axis 51 by air from the air nozzle 34. The swirling air and propane vapor mixture is then ignited by sparks from the spark plug 24, forming a flame (not shown). The flame exits through annular pathway 62. The assembly 10 also has a fuel pit 64. The flame disperses through the fuel pit 64. The fuel pit 64 has pit water 66, which has a top level 68. The water level 68 may vary above or below the cylinder water level 58.

In operation, the liquid pilot assembly 10 acts as a self-igniting continuous pilot flame device. The assembly 10 is used to reliably ignite combustible fuel supplies. The assembly consists of an igniter unit 12 to electronically light a pilot flame, the vaporizer 20 and the fuel distribution line 14 to dispense the pilot fuel, and an air distribution line 16 to provide combustion air. The components 12, 14, 16 are built as a modular assembly 10. The assembly 10 is designed for use in a fuel spill fire training simulator. The assembly 10 is positioned in the fuel spill pit 64, partially submerged in water, with only the upper surface of the assembly 10 exposed to view.

The spark plug 24 creates a spark which directly ignites the pilot flame. An energy source (not shown) for the spark plug 24 is provided remotely by a separate module (not shown) and the spark itself is produced by the spark plug 24. Spark unit 12 has a turbine engine type spark plug. This type of spark plug has no gap between its electrodes, so there is virtually no chance that foreign materials will bridge an igniter gap and prevent operation. The igniter unit 12 is essentially self-cleaning due to the high energy of the spark produced. The spark unit 12 is mounted in the pilot housing 18 and is easily removed for component replacement or wiring. The spark plug 24 is positioned so water and extinguishing agents roll off the surface, thereby prolonging component life and improving reliability.

The fuel distribution system 14 consists of a tube 26 and nozzle 28 which dispense fuel beneath the surface 58 of the water. This system 14 is connected to a controlled remote fuel source (not shown).

The air distribution system 16 includes a nozzle 34 mounted above the surface 58 of the water. The air system 16 is connected to a regulated remote air source which supplies a constant flow of clean, compressed air. This air improves the combustion process and prevents the local air/fuel mixture from becoming too rich.

The assembly 10 includes frame angles 42, 44 which mount to the base of the fuel spill pit. Chamber 38 is filled with stone. Chamber 38 contains the igniter spark unit 12, a fitting connected to an electrical conduit (not shown) and provisions for mounting the fuel distribution nozzle 28, air distribution nozzle 34 and a thermal sensor (not shown). The top of assembly 10 has a metal cover 46 which serves to shield the pilot flame from wind, rain, extinguishing agents, etc. The cover 46 also protects the parts 34, 28, 24 from physical damage.

The liquid pilot assembly 10 is operated remotely by way of a computer (not shown) or electro-mechanical operator console (not shown). Upon pilot command, an electrical signal is sent to the spark plug 24, and a continuous spark is produced. At the same time, a fuel valve (not shown) is opened and liquid propane flows out of the fuel distribution nozzle 28. This fuel vaporizes and mixes with air and is subsequently ignited by the spark. A thermal sensor (not shown) is mounted near the top of the dispersion chamber 38 and is used to verify that the pilot flame is lit.

Liquid pilot assembly 10 has the unique ability to reliably vaporize and ignite liquid propane within assembly 10, without the use of a conventional propane vaporizer and vapor distributor network. The liquid propane is released beneath the water and is vaporized as it travels through the water in the dispersion chamber 38 to the top of the assembly 10. The vapor is then ignited by the spark generated by the igniter. The chamber 38 is filled with stones 52 to reduce water bubbling and splashing within the chamber 38 as the propane expands during vaporization. The compressed air aids the combustion process by mixing with the vaporized fuel and insuring a proper fuel air mixture.

The addition of compressed air also makes this assembly 10 unique. The continuous flow of high pressure air keeps the burn area clear of debris and extinguishing agents. Extinguishing foams are particularly difficult to disperse from the pilot area around spark plug 24 due to their physical consistency. These foams form a thin film around the fuel as it escapes from the water and prevents the fuel from mixing with the surrounding air, which in turn prevents the pilot flame from igniting. The air from the air distribution nozzle 34 helps to clear the foam away from the local burn area and breaks any foam bubbles, thereby mixing air with the fuel. The air further helps to keep the tip of the spark plug 24 cool and dry, which improves overall assembly reliability.

Some of the advantages of the assembly are indicated hereafter:

A) Assembly 10 has the ability to vaporize and ignite a liquid propane fuel source. In a liquid propane fueled system, this eliminates the need for running a separate vapor line from the tank farm to each pilot area. This also eliminates all of the hardware (valves, regulators, vaporizers, etc.) associated with either drawing vapor off the top of the supply tank or vaporizing liquid propane pumped out of the bottom of the tank.

B) Assembly 10 uses water 56 as a dispersion medium and helps insure that liquid propane is fully vaporized by the time it reaches the ignition source. The liquid propane travelling through the underwater piping will be heated by the water, beginning the vaporization process. Any propane still in liquid form at the time of discharge will be quickly vaporized as it travels to the surface.

C) The liquid pilot assembly 10 is mounted in pit 64, partially submerged in pit water 66. This arrangement helps protect the components from damage. The water 56 prevents direct flame impingement on most of the components, and acts as a large heat sink to help cool the components above the surface of the water.

D) Assembly 10 uses compressed air and thus helps keep the combustion area clear of debris. The continuous air supply keeps the burn area clear of debris and extinguishing agents. Extinguishing foams are particularly difficult to disperse from the pilot area due to their physical consistency. These foams form a thin film around the fuel as it escapes from the water and prevents the fuel from mixing with the surrounding air, which in turn prevents the pilot flame from lighting. The air from the air distribution nozzle 34 helps to clear the foam away from the local burn area and breaks any foam bubbles, thereby mixing air with the fuel. The air also helps keep the spark plug tip cool and dry, which improves reliability.

E) Assembly 10 uses compressed air and thus aids the combustion process by mixing with the fuel and preventing an overly rich fuel condition.

F) Assembly 10 has the ability to be used outdoors, relatively unaffected by weather conditions. The liquid pilot assembly 10 can withstand most outdoor environments.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A liquid pilot assembly for use in a fuel pit for igniting combustible fuel in the pit comprising:

a housing forming a chamber for retaining a mixture of liquid fuel and water, the chamber containing an upper ignition zone for receiving a mixture of ambient air and fuel vapor produced from the liquid fuel;

an igniter unit means located in the chamber and adjacent to the ignition zone for providing as required electronically igniting of the fuel vapor in the ignition zone;

a fuel system means for supplying said liquid fuel to the chamber; and a vaporization subassembly comprising an air distribution system for continuously supplying compressed air to prevent the ambient air and fuel vapor mixture from becoming too rich, assisting in the changing of liquid fuel to fuel vapor and for swirling the fuel vapor from the fuel in the ignition zone.

2. The assembly of claim 1, wherein the igniter unit includes:

an inclined pipe supported by the housing;

a cap supported by the inclined pipe; and a spark plug which is supported by the cap.

3. The assembly according to claim 1, wherein the fuel system includes:

an inlet line and a lower outlet nozzle supported by the housing.

4. The assembly according to claim 1, wherein the air distribution system comprises:

an inlet line for supplying compressed air, a vertical tube extending from the inlet line for conducting the air; and an upper outlet nozzle in the ignition zone connected to the vertical tube for discharging the air and arranged to cause a circular air flow around the outlet nozzle.

5. The assembly of claim 1 wherein said housing comprises a peripheral metal shell to form the chamber for retaining the mixture of fuel and water, and said metal shell supports said igniter unit means.

6. The assembly according to claim 5 wherein said housing is supported by a welded floor plate which stands on leg angles.

7. The assembly according to claim 1 wherein said igniter unit means contains a spark plug without a spark gap between electrodes.

8. A liquid pilot assembly for use in a fuel pit for igniting combustible fuel in the pit comprising:

a housing forming a chamber for retaining a mixture of liquid fuel and water, the chamber containing an upper ignition zone for receiving a mixture of ambient air and fuel vapor produced from the liquid fuel;

an igniter unit means located in the chamber and adjacent to the ignition zone for providing as required electronically igniting of the fuel vapor in the ignition zone;

a fuel system means for supplying said liquid fuel to the chamber; and a vaporization subassembly comprising an air distribution system for continuously supplying compressed air to prevent the ambient air and fuel vapor mixture from becoming too rich, assisting in the changing of liquid fuel to fuel vapor and for swirling the fuel vapor from the fuel in the ignition zone, wherein the housing includes:

a peripheral wall having an axis;

a chamber enclosed by the peripheral wall;

a floor plate which supports the peripheral wall;

a plurality of support members which support the floor plate;

a hood which covers the chamber and which is axially spaced from the top of the peripheral wall in order to allow a pathway for flame between the hood and the peripheral wall at the top thereof and which encloses the ignition zone.

9. The assembly according to claim 6, wherein the vaporization subassembly includes a plurality of gravel stones disposed in the chamber in the mixture of water and fuel to a selective level; and a volume of water disposed in the chamber to a selective level below the ignition zone, for changing liquid fuel to vapor fuel by heat exchange of the cold liquid fuel through the warmer gravel and water in an upward direction to the ignition zone.

* * * * *